US008266914B2

(12) United States Patent
Hawie et al.

(10) Patent No.: US 8,266,914 B2
(45) Date of Patent: Sep. 18, 2012

(54) HEAT SHIELD SEALING FOR GAS TURBINE ENGINE COMBUSTOR

(75) Inventors: Eduardo Hawie, Woodbridge (CA); Hayley Ozem, Mississauga (CA)

(73) Assignee: Pratt & Whitney Canada Corp., Longueuil (CA)

( * ) Notice: Subject to any disclaimer, the term of this patent is extended or adjusted under 35 U.S.C. 154(b) by 979 days.

(21) Appl. No.: 12/255,995

(22) Filed: Oct. 22, 2008

(65) Prior Publication Data

US 2010/0095678 A1 Apr. 22, 2010

(51) Int. Cl.
*F02C 7/20* (2006.01)

(52) U.S. Cl. ..... 60/800; 60/796

(58) Field of Classification Search ..... 60/796, 60/799, 800, 752, 754–760, 804, 39.37, 772, 60/797

See application file for complete search history.

(56) References Cited

U.S. PATENT DOCUMENTS

| | | | | |
|---|---|---|---|---|
| 3,899,876 | A | 8/1975 | Williamson | |
| 4,901,522 | A | 2/1990 | Commaret et al. | |
| 5,233,828 | A | 8/1993 | Napoli | |
| 5,241,827 | A | 9/1993 | Lampes | |
| 5,279,127 | A | 1/1994 | Napoli | |
| H0001380 | H * | 12/1994 | Halila et al. | 60/757 |
| 5,435,139 | A | 7/1995 | Pidcock et al. | |
| 5,483,794 | A | 1/1996 | Nicoll et al. | |
| 5,799,491 | A | 9/1998 | Bell et al. | |
| 6,286,317 | B1 | 9/2001 | Burrus et al. | |
| 6,895,757 | B2 | 5/2005 | Mitchell et al. | |
| 6,895,761 | B2 | 5/2005 | Mitchell et al. | |
| 7,093,439 | B2 | 8/2006 | Pacheco-Tougas et al. | |
| 7,093,440 | B2 * | 8/2006 | Howell et al. | 60/752 |
| 7,093,441 | B2 | 8/2006 | Burd et al. | |
| 7,152,411 | B2 * | 12/2006 | McCaffrey et al. | 60/796 |
| 7,363,763 | B2 * | 4/2008 | Coughlan et al. | 60/752 |
| 7,788,928 | B2 * | 9/2010 | De Sousa et al. | 60/753 |
| 2002/0116929 | A1 | 8/2002 | Snyder | |
| 2002/0184892 | A1 * | 12/2002 | Calvez et al. | 60/796 |
| 2007/0144178 | A1 | 6/2007 | Burd et al. | |
| 2007/0186558 | A1 | 8/2007 | De Sousa et al. | |
| 2007/0186559 | A1 | 8/2007 | De Sousa et al. | |

* cited by examiner

*Primary Examiner* — William H Rodriguez
*Assistant Examiner* — Carlos A Rivera
(74) *Attorney, Agent, or Firm* — Norton Rose Canada LLP

(57) ABSTRACT

A combustor heat shield sealing arrangement comprises a sealing rail extending from the combustor liner shell at the exit of the combustor for sealing engagement with a rail-less downstream end portion of the combustor heat shield. The sealing rail is offset relative to the downstream vane passage. Doing so may minimize the combustor/vane waterfall and, thus, minimize the horseshoe vortex effect at the leading edge of the turbine vanes.

10 Claims, 3 Drawing Sheets

HEAT SHIELD SEALING FOR GAS TURBINE ENGINE COMBUSTOR

TECHNICAL FIELD

The application relates generally to gas turbine engine combustors and, more particularly, to a sealing arrangement for liner heat shields.

BACKGROUND OF THE ART

The cooling of a gas turbine engine combustor downstream end portion has always been challenging. As the hot combustion products exit the combustor and approach the first stage of turbine vanes, high static pressure regions are created particularly at the vanes leading edge near the vane platforms. Those high static pressure regions result in the formation of vane bow waves also known as horseshoe vortices. Such horseshoe vortices tend to prevent cooling air from flowing over the vane platform and may even drive the hot combustor gases back toward the combustor end walls, thereby resulting in localized overheating problems.

Accordingly, there is a need to minimize or reduce the horseshoe vortex effect at the leading edge of the turbine vane immediately downstream of the combustor outlet end.

SUMMARY

In one aspect, there is provided a combustor for discharging a flow of combustion gases to a first stage of turbine vanes of a gas turbine engine, the turbine vanes having airfoils extending across a first stage turbine vane passage, the combustor comprising a combustor liner shell circumscribing a combustion chamber, said combustion chamber having an outlet end adapted to be disposed immediately upstream of the first stage of turbine vanes for directing a flow of combustion gases thereto, at least one circumferential array of heat shield panels mounted to an interior side of the combustor liner shell at said outlet end, the heat shield panels having an exterior side disposed in a spaced-apart facing relationship with the interior side of the combustor liner shell to define a gap therewith, cooling holes defined in said combustor liner shell for directing a coolant in said gap, and a circumferential sealing rail integral to the combustor liner shell and protruding inwardly from a trailing edge portion of the interior side of the combustor liner shell to a rail-less trailing edge area of the exterior surface of the heat shield panels to seal said gap at said outlet end of said annular combustion chamber.

In a second aspect, there is provided a gas turbine engine combustor exit arrangement comprising radially inner and radially outer combustor liner shells defining an annular combustion chamber, a first stage of turbine vanes provided at an outlet of said annular combustion chamber for receiving a flow of combustion gases therefrom, each turbine vanes comprising an airfoil extending between inner and outer vane platforms, the inner and outer vane platforms bounding a turbine vane passage, inner and outer circumferential arrays of heat shield panels respectively mounted to an interior side of the radially inner and radially outer combustor liner shells and bounding said outlet, the heat shield panels having an exterior side disposed in a spaced-apart facing relationship with the interior side of the radially outer and radially inner combustor liner shells to define respective inner and outer gaps therewith, cooling holes defined in the radially outer and radially inner combustor liner shells for directing coolant in the outer and inner gaps, a circumferential rail extending from the interior side of the radially outer and radially inner combustor liner shells at said outlet for sealing engagement with an exterior side of the heat shield panels, wherein the interior surface of the heat shield panels of the inner and outer circumferential arrays define inner and outer waterfall with an associated one of the inner and outer turbine vane platforms, the inner and outer waterfalls being generally limited to a thickness of the heat shield panels.

In a third aspect, there is provided a method of cooling a downstream exit end portion of a gas turbine engine combustor, the method comprising: minimizing a waterfall at a combustor/vane interface by providing an end wall circumferential sealing rail on a liner shell of the combustor for sealing-engagement with a rail-less trailing end of a combustor heat shield at a location disposed at or closely radially outside of a vane passage boundary, and providing for effusion cooling of the heat shield.

Further details of these and other aspects of the present invention will be apparent from the detailed description and figures included below.

DESCRIPTION OF THE DRAWINGS

Reference is now made to the accompanying figures, in which.

DETAILED DESCRIPTION OF THE PREFERRED EMBODIMENTS

Figure 1:
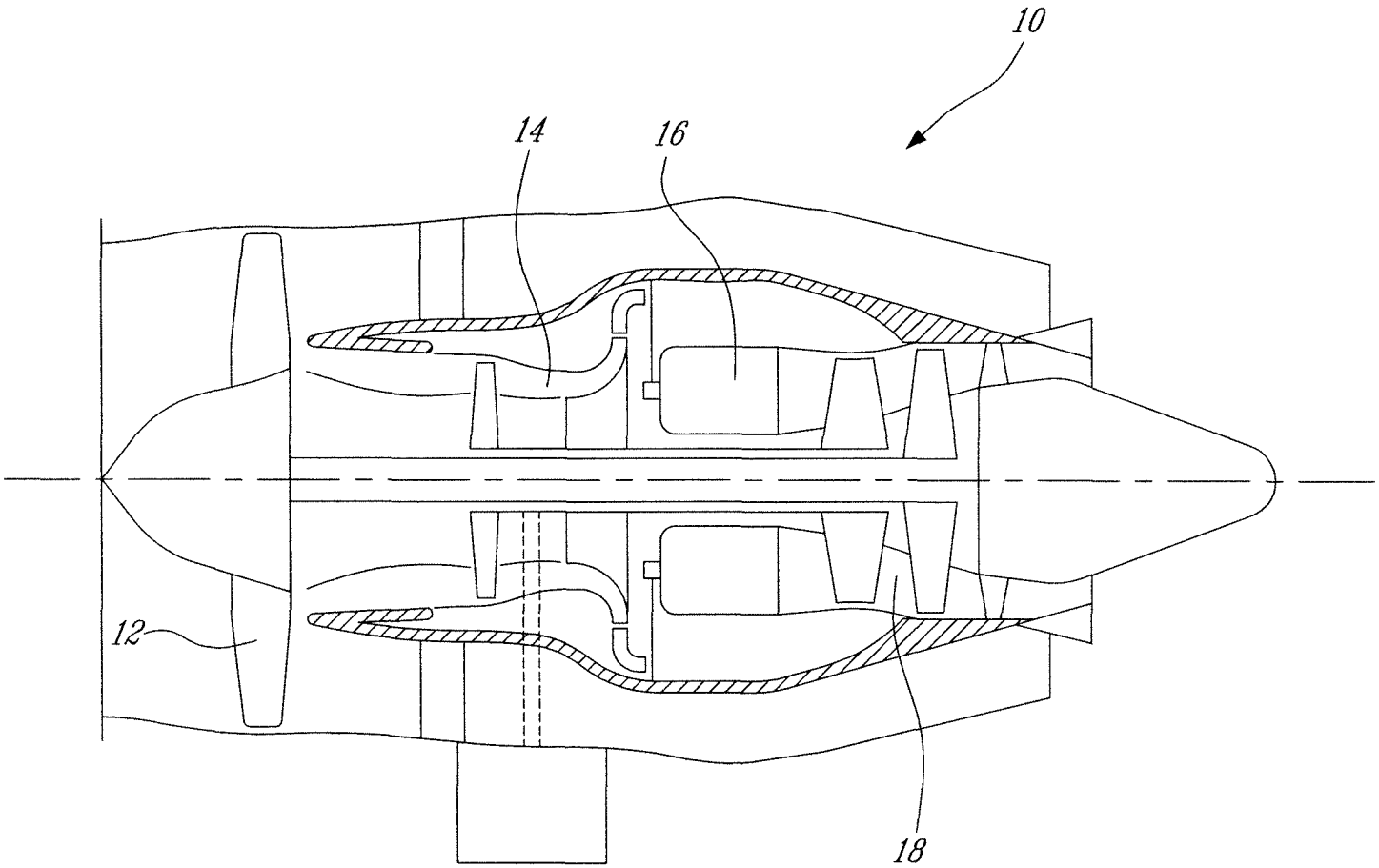
FIG. 1 is a cross-sectional schematic view of a gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
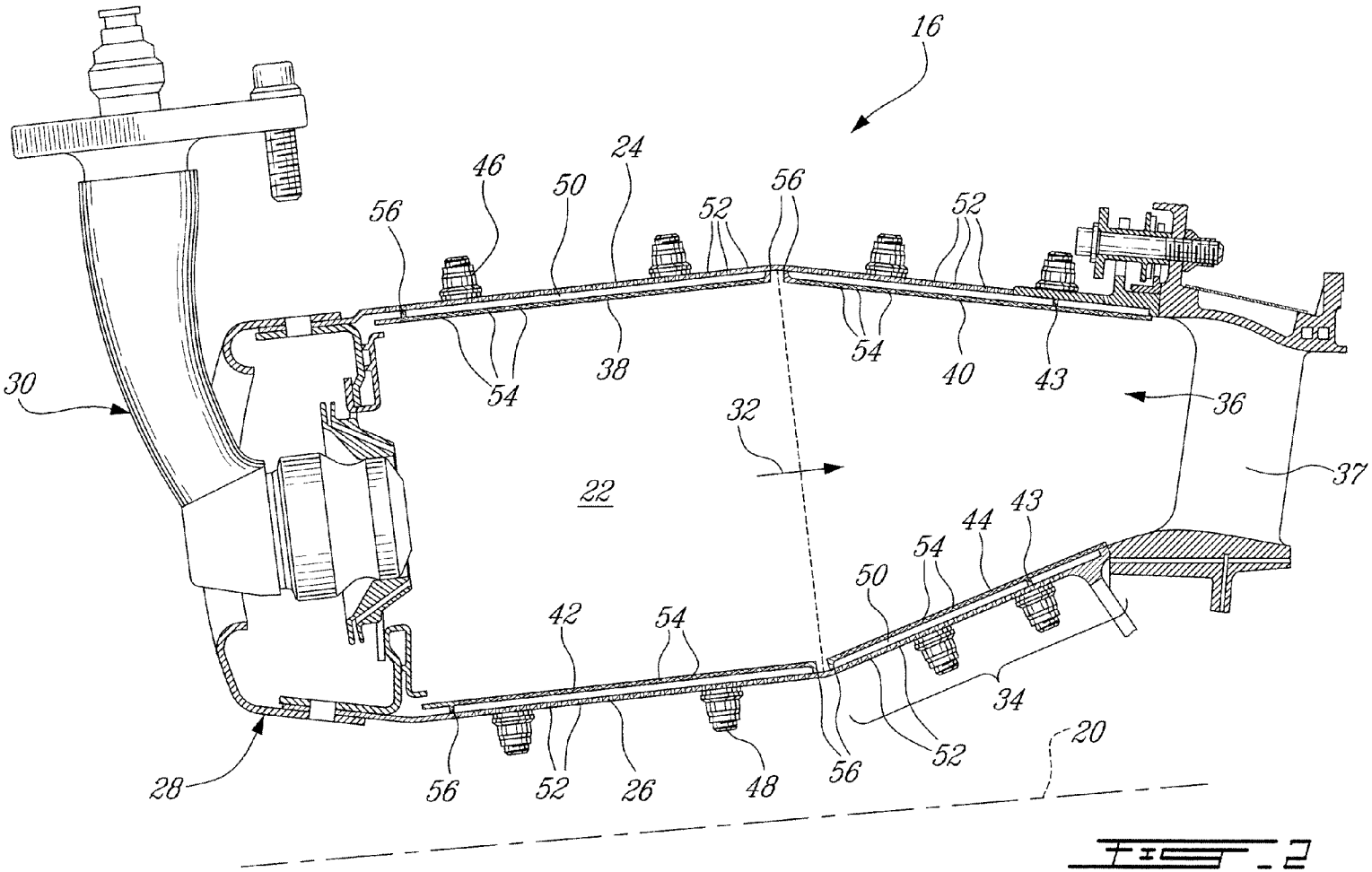
FIG. 2 is a longitudinal cross-sectional view of the combustor of the gas turbine engine.

As shown in FIG. 2, the combustor 16 can be provided in the form of an annular straight-through combustor mounted about a central longitudinal centerline 20 of the engine 10. The combustor 16 has an annular combustion chamber 22 bounded by radially outer and radially inner liner shells 24 and 26 extending axially rearwardly from an upstream end wall or bulkhead 28. A plurality of circumferentially spaced-apart nozzles (only one being shown at 30 in FIG. 2) are provided at the bulkhead 28 to inject a fuel/air mixture into the combustion chamber 22. Spark plugs (not shown) are provided along the upstream end portion of the combustion chamber 22 downstream of the tip of the nozzles 30 in order to initiate combustion of the fuel air mixture delivered into the combustion chamber 22.

As shown by arrow 32, the combusting mixture is driven downstream within the combustor chamber 22 through a downstream or outlet section 34 to a combustor outlet 36 disposed immediately upstream of the first stage of high pressure turbine vanes 37.

The radially inner and outer liner shells 24 and 26 are provided on their hot interior side (hot-facing the combustion chamber) with heat shields. The heat shields can be segmented to provide a thermally decoupled combustor arrangement. For instance, forward and rear circumferential arrays of heat shield panels 38 and 40 can be mounted to the hot interior side of the radially outer liner shell 24, while forward and rear circumferential arrays of heat shield panels 42 and 44 can be mounted to the hot interior side of the radially inner liner shell 26. Nuts 46 can be threadably engaged onto threaded studs 48 extending integrally from the cold exterior side of the heat shield panels 38, 40, 42 and 44 to fixedly retain the same on the interior side of the outer and inner liner shells 24 and 26. The heat shield panels 38, 40, 42 and 44 are held with their exterior side (cold-facing away from combustion chamber) facing and spaced-apart from the interior side of the associated outer and inner liner shells 24 and 26, thereby defining a gap 50 therebetween.

Pressurized cooling air is introduced in the gap 50 between the liner shells 24 and 26 and the heat shield panels 38, 40, 42 and 44 to cool down the heat shield panels. Impingement holes 52 can, for instance, be defined through the outer and inner liner shells 24 and 26 to direct jets of cooling air through the gap 50 against the back or exterior side of the heat shield panels 38, 40, 42 and 44. Effusion holes 54 can be defined through the heat shield panels 38, 40, 42 and 44 to provide convection cooling while the air flows through the holes 54 and then film cooling over the hot interior side of the heat shield panels. The holes 54 are so angled as to be aligned in a generally downstream direction with regard to the combustion flow 32 through the combustor 16.

Axially and circumferentially extending sealing rails (see for instance circumferential rails at 56 in FIG. 2) extend integrally from the exterior side of the heat shield panels 38, 40, 42 and 44 to sealingly engage the interior side of the associated outer and inner liner shells 24 and 26. The sealing rails 56 compartmentalize the gap 50 into a plurality of sealed compartments to create the proper pressure drop splits between the liner shells 24 and 26 and the heat shield panels 38, 40, 42 and 44. According to the illustrated example, the forward heat shield panels 38 and 40 are provided with circumferential sealing rails 56 at both the upstream and downstream edge portions thereof. Axially extending sealing rails (not shown) are typically provided along the axially extending side edges of each heat shield panels between opposed upstream and downstream edges thereof. Unlike the forward heat shield panels 38 and 40, the rear heat shield panels 42 and 44 have a rail-less downstream edge portion at the outlet 36 of the combustion chamber 22.

Figure 3:
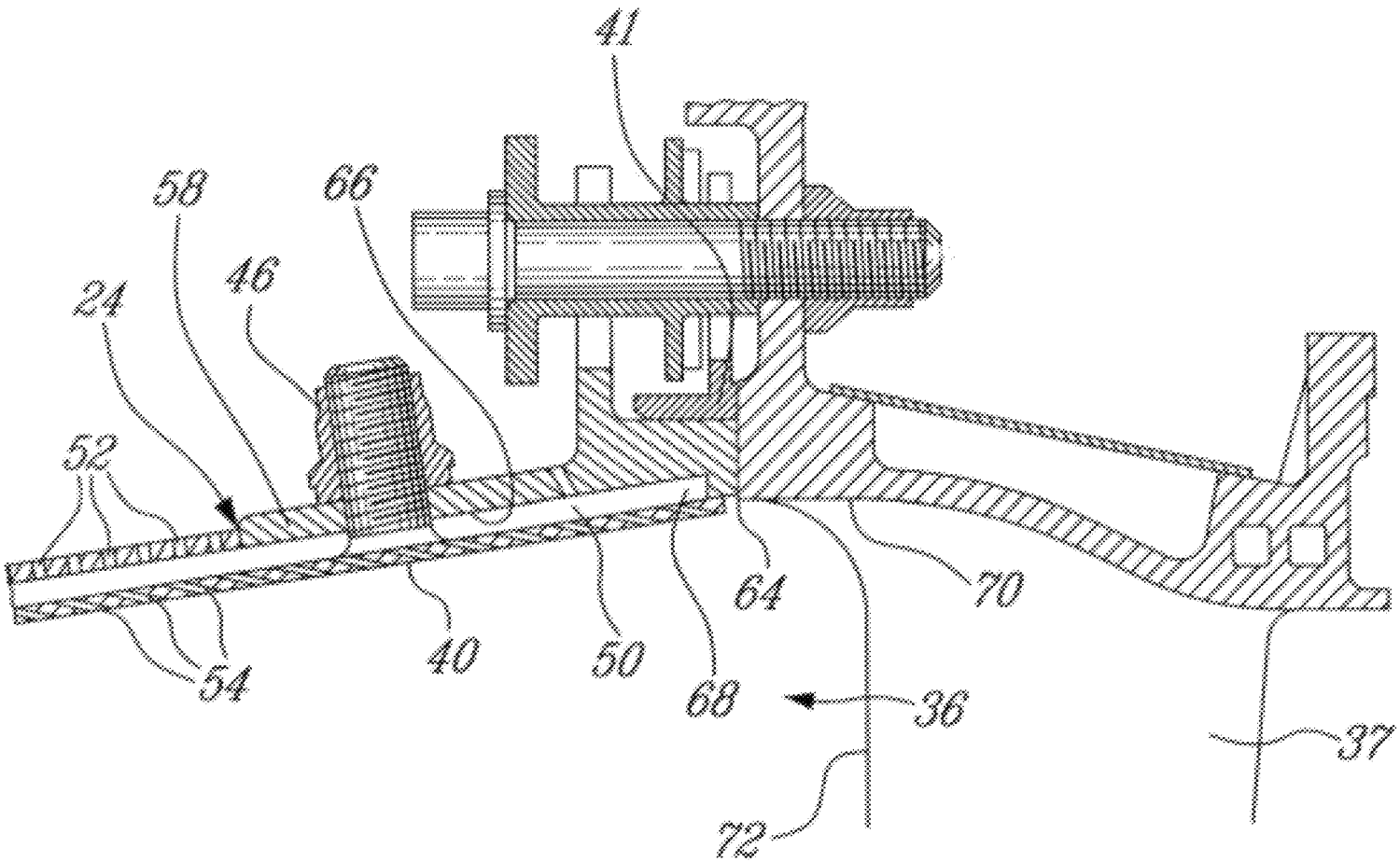
FIG. 3 is an enlarged cross-sectional view of a trailing or exit end portion of the combustor illustrating a sealing arrangement between a combustor liner and a heat shield mounted inside the combustor liner just upstream of the first stage of high pressure turbine vanes.

Referring more particularly to FIG. 3, the details of the sealing arrangement between the rear heat shield panels 40 and 44 and the combustor shell at the combustor outlet 36 will now be described in connection with the rear heat shield panel 40 and the radially outer liner shell 24, the sealing arrangement between the rear heat shield panels 44 and the radially inner liner shell 26 being generally similarly formed and thus the duplicate description thereof will be omitted. The outer liner shell 24 comprises a thickened downstream end portion which provides radial sealing between the "belly band" 41 and the liner 24. The "belly band" 41 also provides sealing against the turbine vane 37. A circumferential sealing rail 64 integral to and projecting inwardly from an interior surface 66 of the thickened downstream end portion 58 of the outer liner shell 24 extends in sealing engagement with a rail-less trailing edge portion of the exterior side 68 of the rear heat shield panel 40 in order to provide a metal to metal type of seal at the downstream end of the rear compartmentalized sections of the cooling gap 50. The sealing rail 64 extends continuously (i.e. no interruption) along a full circumference of the outlet of the combustor. The provision of the rear sealing rail 64 on the liner shell 24 as opposed to on the rear heat shield panel 40 allows to effectively effusion cool the heat shield panel 40 along all the extent thereof that is down to its trailing edge. This would not be possible if the sealing rail was to be provided on the heat shield due to the thermal gradients created by the hot walls of the heat shield 40 and the colder rails 56 of the heat shields 40 at the exit of the combustor. This thermal gradient, in conjunction with the effusion holes would create stresses high enough to limit the durability of the heat shields. The rail provided at 43 (see FIG. 2) allows the designer to allocate flow tailored to cool the exit of the combustor without compromising the flow splits allocated to cool the rest of the heat shield panel, regardless of the manufacturing tolerances that will set the gaps between the heat sheat panel 40 and the rail 64.

The provision of the rear sealing rail 64 on the combustor liner shell 24 allows minimizing the waterfall step (i.e. the distance or height difference) between the interior side of the rear heat shield panels 40 and the radially outer vane platform surface 70 to roughly the thickness of the heat shield panels 40. Reducing the waterfall or step down at the combustor/vane interface is beneficial in that it allows to minimize the vane bow wave or horseshoe effect which is known to be particularly important at the turbine vane leading edge 72 near the inner an outer platforms of the first stage of turbine vanes. When the flow of combustion gases approaches the turbine vane leading edge 72, it stagnates at the vane leading edge, thereby giving rise to localized high static pressure zones. This results in high pressure gradients and complex three-dimensional flows. The three-dimensional flows tend to wrap around the leading edge 72 of the turbine vanes 37 in a U-shape with one leg extending along the pressure side of the vanes 37 and one leg extending along the suction side of the vanes 37. The pressure gradients make it difficult to cool down the turbine vane platforms and the downstream end of the combustor 16, including the rear heat shield panels 40, 44 and the combustor liner shell, because the pressure difference of the cooling fluid relative to the hot combustion fluid is no longer sufficient in order to ensure a continuous flow of cooling fluid over the interior surface of the rear heat shield panels 40 and 44 and the vane platform surfaces 70. Indeed, the cooling flow will tend to be directed towards region of lower static pressure. This may even result in hot gas ingestion in the rear compartmentalized regions of the gap 50 between the heat shield panels 40, 44 and the combustor liner shell 24, 26 where the pressure of the hot combustion gases is locally greater than the pressure of the cooling fluid. Local penetration of hot combustion gases into the gap 50 or even into the cooling-fluid film on the interior surface of the heat shield panels 40, 44 may result in non-negligible local overheating problems.

As shown in FIG. 3, the placement of the rear sealing rail 64 on the combustor liner shell 24 allows minimizing the waterfall at the combustor/vane interface by providing a relatively smooth transition at all running conditions. It substantially eliminates the presence of a back end wall at the combustor/vane interface. The discontinuity between the vane platform surface 70 and the combustor downstream end is limited to the thickness of the heat shield panels 40. Such a minimized waterfall or small step-down contributes to prevent boundary flow separation which, in turn, has proven to minimize the horseshoe vortex effect, thereby facilitating the cooling of the trailing edge portion of the combustor 16. The magnitude of the waterfall is a range of about 0.000" at worse running condition to about 0.030" at cold condition, but this gap is specific to the arrangement of the design. The goal is to minimise the waterfall at worst running condition, taking into account all the manufacturing tolerances. Also, as can be appreciated from FIG. 3, the cooling air leakage that naturally occurs between the rear sealing rail 64 and the exterior surface 68 of the rear heat shield panels 40 at running conditions will be substantially axially in-line with the surface of the vane platform 70, thereby providing for a smooth flow transition at the exit of the combustor 16. In contrast, a rear sealing rail extending from the exterior surface of the rear heat shield 40 towards the outer combustor liner shell 24 would cause the cooling leakage flow to have a radially outward component, which would promote turbulences in the boundary flow and, thus, boundary flow separation.

The provision of the rear circumferential sealing rail 64 on the combustor outer liner shell 24 also allows building a heat shield without having to worry about cooling the last circumferential sealing rail. The sealing rail 64 of the liner shell 24 is not directly exposed to the interior of the combustion chamber 22 and as mentioned herein before cooling air leakage will naturally occur between the rail 64 and the trailing end of the heat shield panels 40.

In view of the foregoing, it can be appreciated that minimizing the horseshoe vortex effect, facilitate cooling of the vane platform and of the downstream end portion of the combustor, thereby improving the service life of the rear heat shields and of the first stage turbine vanes.

The above description is meant to be exemplary only, and one skilled in the art will recognize that changes may be made to the embodiments described without departing from the scope of the invention disclosed. For example, the invention is not limited to straight-through combustors, but is rather applicable to all type of thermally decoupled combustors. Still other modifications which fall within the scope of the present invention will be apparent to those skilled in the art, in light of a review of this disclosure, and such modifications are intended to fall within the appended claims.

What is claimed is:

1. A combustor for discharging a flow of combustion gases to a first stage of turbine vanes of a gas turbine engine, the turbine vanes having airfoils extending across a first stage turbine vane passage, the combustor comprising a combustor liner shell circumscribing a combustion chamber, said combustion chamber having an outlet end configured for mounting to an upstream side of the first stage of turbine vanes for directing a flow of combustion gases thereto, at least one circumferential array of heat shield panels mounted to an interior side of the combustor liner shell at said outlet end, the heat shield panels having an exterior side disposed in a spaced-apart facing relationship with the interior side of the combustor liner shell to define a gap therewith, cooling holes defined in said combustor liner shell for directing a coolant in said gap, and a circumferential sealing rail integral to the combustor liner shell and protruding inwardly from a trailing edge portion of the interior side of the combustor liner shell to a rail-less trailing edge area of the exterior surface of the heat shield panels to seal said gap at said outlet end of said annular combustion chamber, and wherein said circumferential sealing rail project inwardly to a location disposed substantially radially outside of the first stage turbine vane passage, the interior side of the heat shield panels being located radially inside the first stage turbine vane passage so as to define a step relative to the first stage turbine vane passage, the step corresponding generally to a distance between the exterior and the interior sides of the heat shield panels.

2. The combustor defined in claim 1, wherein the outlet end of the combustor chamber presents a step defining annular end surfaces facing away from the first stage turbine vane passage, said annular end surfaces being generally limited to a thickness of a platform of the first stage of turbine vanes.

3. The combustor defined in claim 1, wherein said circumferential sealing rail is uninterrupted along a full circumference of said outlet end.

4. The combustor defined in claim 1, wherein the combustion chamber is annular, the combustor liner shell comprising a radially outer liner shell and a radially inner shell, and wherein the at least one circumferential array of heat shield panels comprises a first array of heat shield panels mounted to the radially outer liner shell and a second array of heat shield panels mounted to the radially inner shell and respectively defining first and second steps relative to the first stage turbine vane passage, the first and second steps being generally limited to a thickness of the heat shield panels of the first and second arrays of heat shield panels.

5. A gas turbine engine combustor exit arrangement comprising radially inner and radially outer combustor liner shells defining an annular combustion chamber, a first stage of turbine vanes provided at an outlet of said annular combustion chamber for receiving a flow of combustion gases therefrom, each turbine vanes comprising an airfoil extending between inner and outer vane platforms, the inner and outer vane platforms bounding a turbine vane passage, inner and outer circumferential arrays of heat shield panels respectively mounted to an interior side of the radially inner and radially outer combustor liner shells and bounding said outlet, the heat shield panels having an exterior side disposed in a spaced-apart facing relationship with the interior side of the radially outer and radially inner combustor liner shells to define respective inner and outer gaps therewith, cooling holes defined in the radially outer and radially inner combustor liner shells for directing coolant in the outer and inner gaps, a circumferential sealing rail extending from the interior side of the radially outer and radially inner combustor liner shells at said outlet protruding towards and in sealing engagement with a substantially axial surface of a rail-less exterior side of the heat shield panels to seal outer and inner gaps, wherein the interior surface of the heat shield panels of the inner and outer circumferential arrays of heat shield panels define inner and outer steps with an associated one of the inner and outer vane platforms, the inner and outer steps being generally limited to a thickness of the heat shield panels.

6. The gas turbine engine combustor exit arrangement defined in claim 5, wherein a sealing interface between the heat shield panels of the outer circumferential arrays of heat shield panels and the circumferential sealing rail extending from the radially outer liner shell is substantially leveled with a hot interior surface of the outer vane platforms of the first stage of turbine vanes.

7. The gas turbine engine combustor exit arrangement defined in claim 6, wherein the circumferential sealing rail extending respectively from the interior side of the radially outer and radially inner combustor liner shells are located radially outside of the turbine vane passage and as such do not form part of the inner and outer steps.

8. The gas turbine engine combustor exit arrangement defined in claim 6, wherein the first and second steps respectively correspond to the distance between the interior surface of the heat shield panels of the inner circumferential array and the inner vane platform and to the distance between the interior surface of the heat shield panels of the outer circumferential array and the outer vane platform, the first and second steps being comprised in range of about 0.000" to 0.030".

9. A method of cooling a downstream exit end portion of a gas turbine engine combustor, the method comprising: minimizing a step at a combustor/vane interface by sealingly engaging an end wall circumferential sealing rail on a liner shell of the combustor with an exterior side surface of a rail-less trailing end of a combustor heat shield at a location disposed at or closely radially outside of a vane passage boundary, the end wall circumferential sealing rail projecting radially inwardly from an inwardly facing surface of the liner shell and sealing an annular gap between the liner shell and the combustor heat shield, providing for effusion cooling of the heat shield, and limiting the step to a dimension substantially corresponding to a thickness of the rail-less trailing end of the combustor heat shield.

10. The method defined in claim 9, comprising axially leaking cooling air at an interface between the end wall circumferential sealing rail and the exterior surface of the heat shield, the interface and the vane passage boundary being substantially leveled to provide for smooth flow surface transition.

* * * * *